US006647681B1

(12) United States Patent
Abbott

(10) Patent No.: US 6,647,681 B1
(45) Date of Patent: Nov. 18, 2003

(54) DECORATIVE BORDER AND METHOD FOR USING SAME

(76) Inventor: Jacquelyn J. Abbott, 2307 Rodlyn Rd., Webster City, IA (US) 50595

( * ) Notice: Subject to any disclaimer, the term of this patent is extended or adjusted under 35 U.S.C. 154(b) by 0 days.

(21) Appl. No.: 10/116,250

(22) Filed: Apr. 4, 2002

(51) Int. Cl.[7] ..... E04B 2/00

(52) U.S. Cl. ..... 52/288.1; 52/312; 52/717.03; 52/717.04

(58) Field of Search ..... 52/288.1, 287.1, 52/716.1, 717.03, 717.04, 717.05, 716.3, 716.4, 311.1, 312, 717.01

(56) References Cited

U.S. PATENT DOCUMENTS

| | | | | | |
|---|---|---|---|---|---|
| 435,845 | A | | 9/1890 | Marston | |
| 3,449,873 | A | | 6/1969 | Damato et al. | |
| 4,028,856 | A | * | 6/1977 | Dalbec | 52/281 |
| 4,058,946 | A | | 11/1977 | Habrant | |
| 4,696,136 | A | * | 9/1987 | Grewe | 52/222 |
| 4,825,612 | A | * | 5/1989 | Tupman | 52/371 |
| 5,406,762 | A | * | 4/1995 | Buard | 52/287.1 |
| 5,711,123 | A | | 1/1998 | Lamont et al. | |
| 5,809,718 | A | | 9/1998 | Wicks | |
| 5,918,435 | A | * | 7/1999 | McGrowen | 52/311.1 |

FOREIGN PATENT DOCUMENTS

FR 2551774 A1 3/1985

* cited by examiner

*Primary Examiner*—Carl D. Friedman
*Assistant Examiner*—Yvonne M. Horton
(74) *Attorney, Agent, or Firm*—McKee, Voorhees & Sease, P.L.C.

(57) ABSTRACT

The decorative border comprises an elongated strip of flexible material. An external reinforcing member engages the front face of the strip and elongated fastening members attach the reinforcing member and the strip to the corner of a wall. Pockets may be provided along the length of the strip and reinforcing slats placed therein. The border has two panels which are sewn together and can be reversed to create different decorative effects.

15 Claims, 6 Drawing Sheets

DECORATIVE BORDER AND METHOD FOR USING SAME

BACKGROUND OF THE INVENTION

This invention relates to a decorative border and method for using same.

Decorative borders have in the past been provided to wall surfaces within rooms. These decorative strips have been formed from wallpaper, and on some occasions are done by stencil or painting. Once the strips are applied to the walls, they require either removal of the wallpaper strip or repainting of the stenciled strip. This is often a time consuming and difficult task.

Therefore a primary object of the present invention is the provision of an improved decorative border and method for using same.

A further object of the present invention is the provision of an improved decorative border that can be removed quickly and easily when desired.

A further object of the present invention is the provision of an improved decorative border that has one decorative pattern on one surface and another decorative pattern on the opposite surface and can be reversed to expose one or the other of these two decorative patterns.

A further object of the present invention is the provision of an improved decorative border that can be washed and vacuumed easily.

A further object of the present invention is the provision of a decorative border that can be matched with curtains, bed attire and other fabrics within the room.

A further object of the present invention is the provision of an improved decorative border that requires no glue.

Another object of the present invention is the provision of an improved decorative border that can be placed over prior wallpaper or stenciled borders.

A further object of the present invention is the provision of an improved decorative border that minimizes the time necessary for installation.

A further object of the present invention is the provision of a decorative border that permits its opposite ends to be tucked within one another.

A further object of the present invention is the provision of an improved decorative border that can be easily stored or packaged.

A further object of the present invention is the provision of an improved decorative border that can be transferred to a room of different size by simply adding or subtracting material product.

A further object of the present invention is the provision of an improved decorative border and method for using same which are economical to manufacture, durable in use and attractive in appearance.

BRIEF SUMMARY OF THE INVENTION

The foregoing objects may be achieved by a decorative border adapted to be attached to a plurality of walls each having corners therebetween. The border comprises an elongated strip of flexible material having an elongated upper edge, an elongated lower edge, first and second opposite ends, a front face and a rear face. An external reinforcing member engages the front face of the strip. An elongated fastening member extends through both the external reinforcing member and the front and rear faces of the strip, and has an inner end penetrating one of the walls adjacent one of the corners between the walls.

According to one feature of the invention the decorative border may be of double thickness comprising first and second layers in face to face relation.

According to another feature of the invention the border can include a plurality of pockets spaced apart along the length of the strip. Each of the pockets has a closed end adjacent the lower edge of the strip, opposite closed sides extending outwardly therefrom, and an open upper end. An elongated rigid reinforcing member is within each of the pockets and has a substantially vertically oriented longitudinal axis.

According to another feature of the invention a tape having tacky adhesive on first and second opposite sides thereof is positioned between the strip and the wall. One tacky side of the tape adheres to the strip and the other tacky side adheres to the wall.

The method of using the decorative border involves taking the elongated strip of decorative material and placing the rear face of the elongated strip in facing engagement with at least one of the walls so that it spans between first and second corners of the walls. The longitudinal axis of the strip extends generally horizontally. It may be positioned adjacent the ceiling or it could be positioned spaced downwardly from the ceiling of the room. The method also includes positioning first and second elongated reinforcing members in the first and second corners respectively with the elongated strip being between the first corner and the first reinforcing member and also between the second corner and the second reinforcing member. The method further comprises securing the first and second reinforcing members to the first and second corners respectively by elongated securing members extending through the first and second reinforcing members, through the strip, and into the wall adjacent the first and second corners respectively.

DETAILED DESCRIPTION OF THE INVENTION

Figure 1:
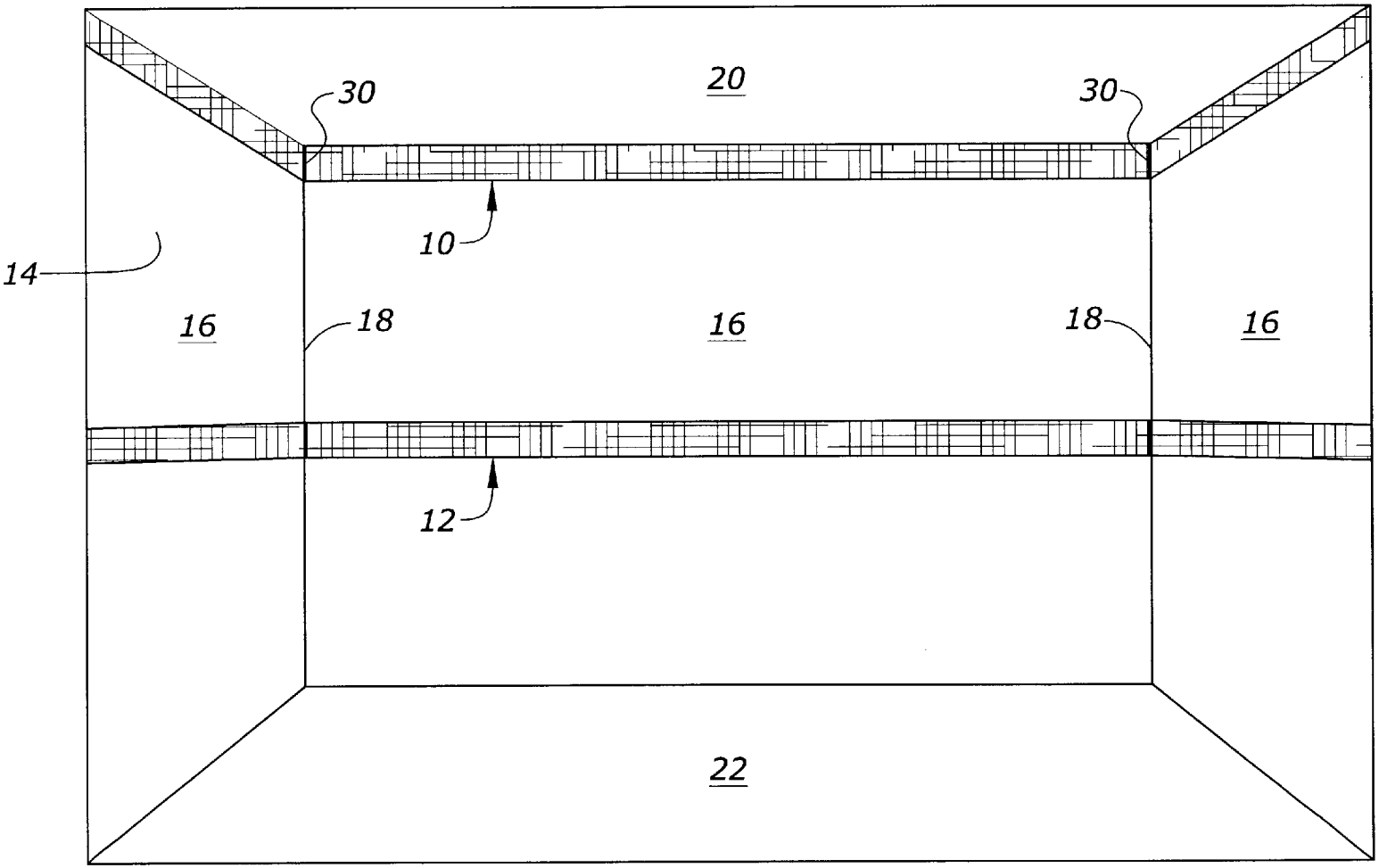
FIG. 1 is a perspective view of a room showing two of the strips, one positioned adjacent the ceiling and the other in a position spaced downwardly from the ceiling.

Referring to FIG. 1 the numeral 10 designates an upper decorative border and the numeral 12 designates a lower decorative border spaced downwardly there from. Border 10 can be placed at the top, middle, bottom, or anywhere on the wall of a room.

The decorative borders 10, 12 are located within a room 14 having a plurality of walls 16 with corners 18 therebetween. A ceiling 20 and a floor 22 are also provided in the room 14.

Figure 5:
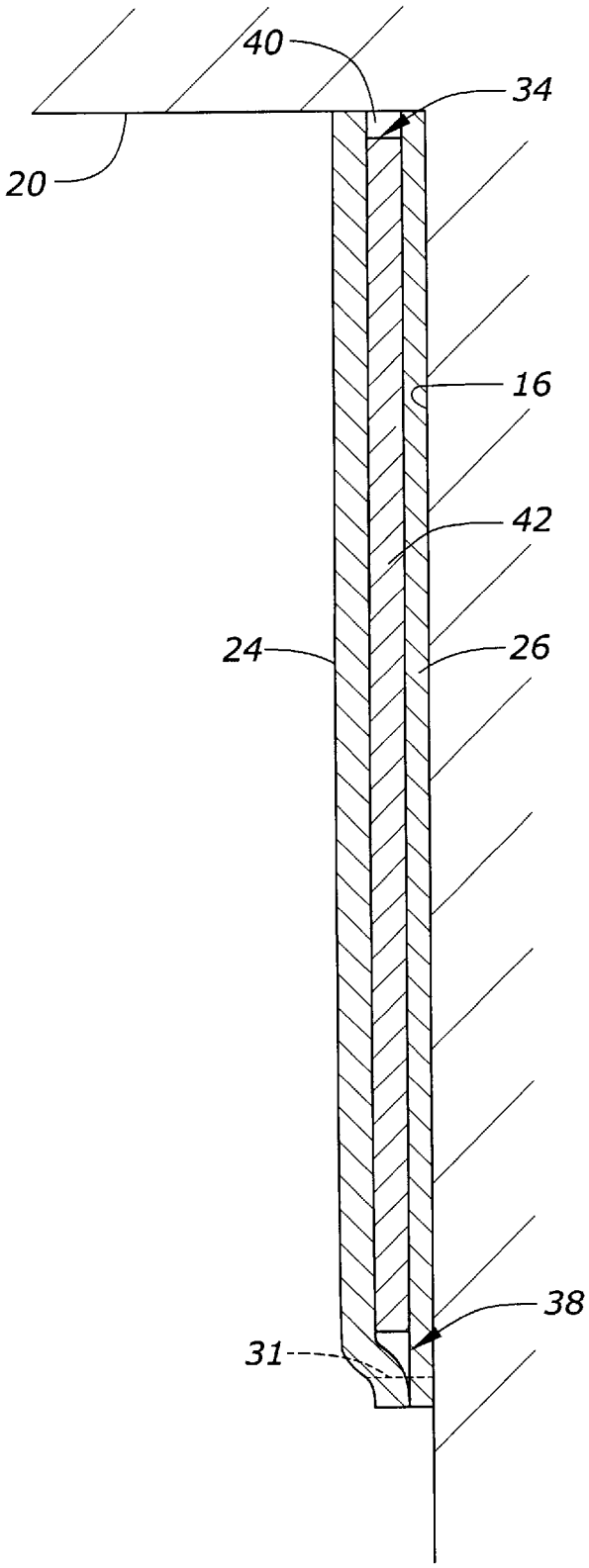
FIG. 5 is a sectional view taken along line 5—5 of FIG. 2.
Figure 6:
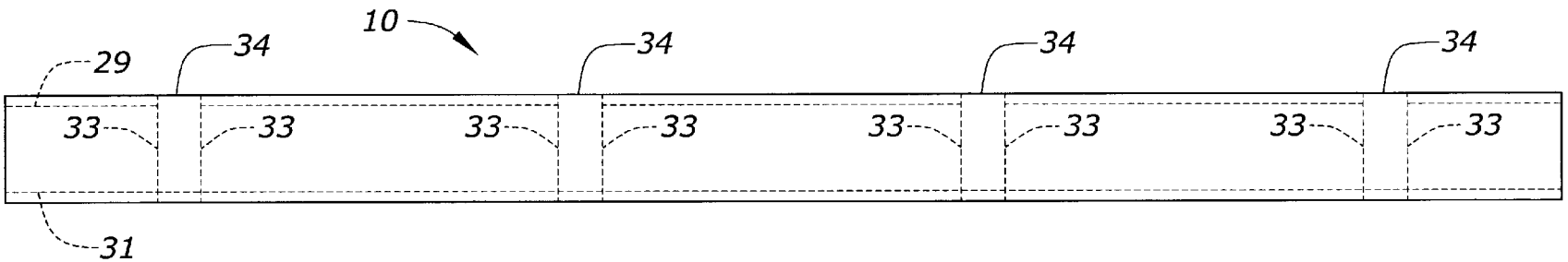
FIG. 6 is a plan view of the elongated decorative border, showing the various stitching patterns therein.

Strips 10, 12 are identical in construction and therefore the following description applies to both. Strip 10 includes a front panel 24 and a back panel 26. These panels may be fabric, plastic, or other flexible sheet material. The preferred material is fabric having predetermined decorative patterns printed thereon. Front panel 24 can have one decorative pattern and rear panel 26 can have an entirely different decorative pattern. These two panels thus can be reversible to create a different decorative border as desired. Between the front and rear panels 24, 26 is an open center 28 which provides an elongated pocket similar to that found with a pillow slip. Referring to FIG. 6, the elongated strip 10 is formed by stitching. The numeral 29 refers to an upper stitch line which extends along the upper edge of the strip 10. The numeral 31 refers to a lower stitch which extends along the bottom edge of strip 10. It should be noted that upper strip 29 has certain intervals therein which are provided with vertically extending spaced apart pocket stitch lines 33. These pocket stitch lines 33 together with the lower stitch line 31 combine to form a pocket 34 having pocket side walls 36 and having a pocket bottom wall 38. The top of the pocket is designated by the numeral 40 in FIG. 5. Fitted within each pocket 34 is an elongated reinforcing slat designated by the numeral 42 in FIG. 5.

Figure 2:
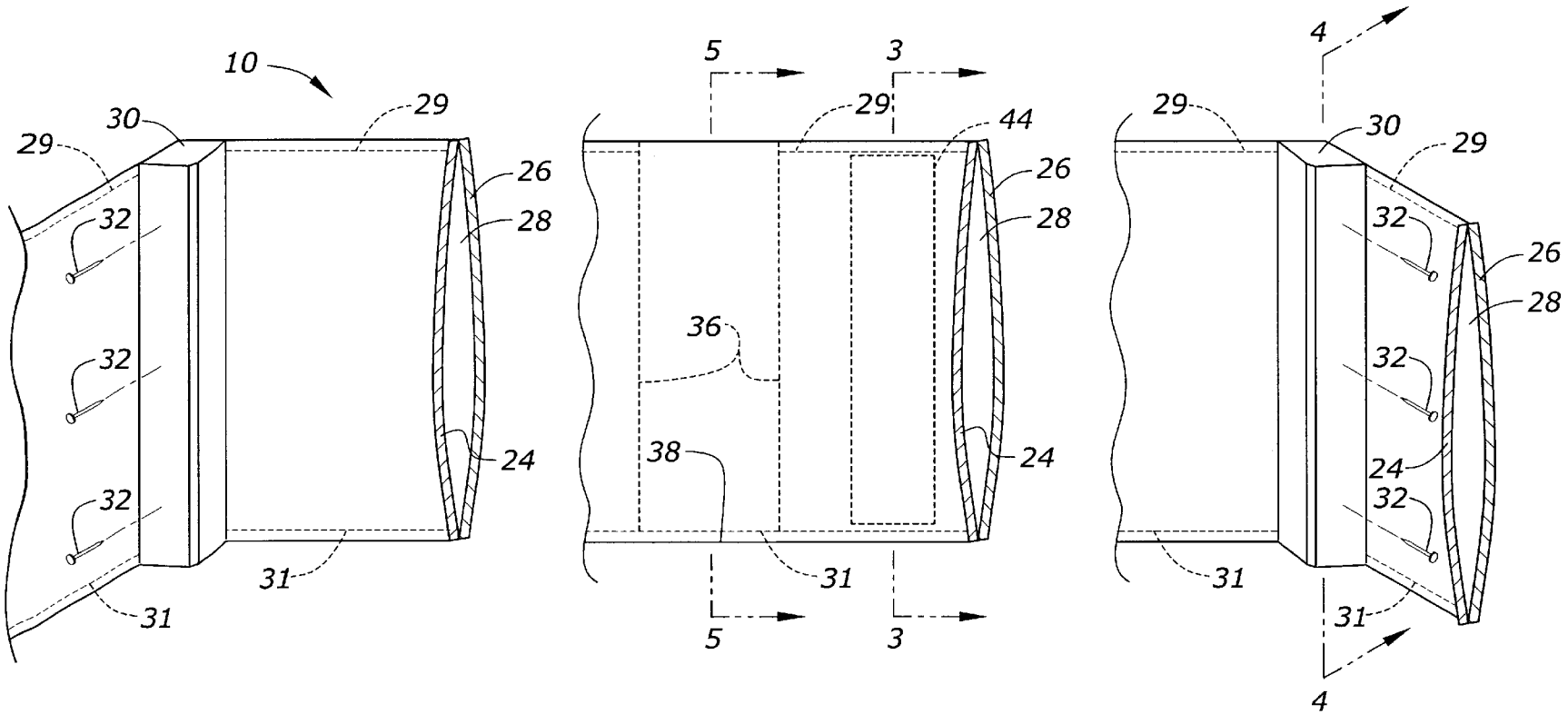
FIG. 2 is a fragmented perspective view of the decorative border used in the present invention.
Figure 4:
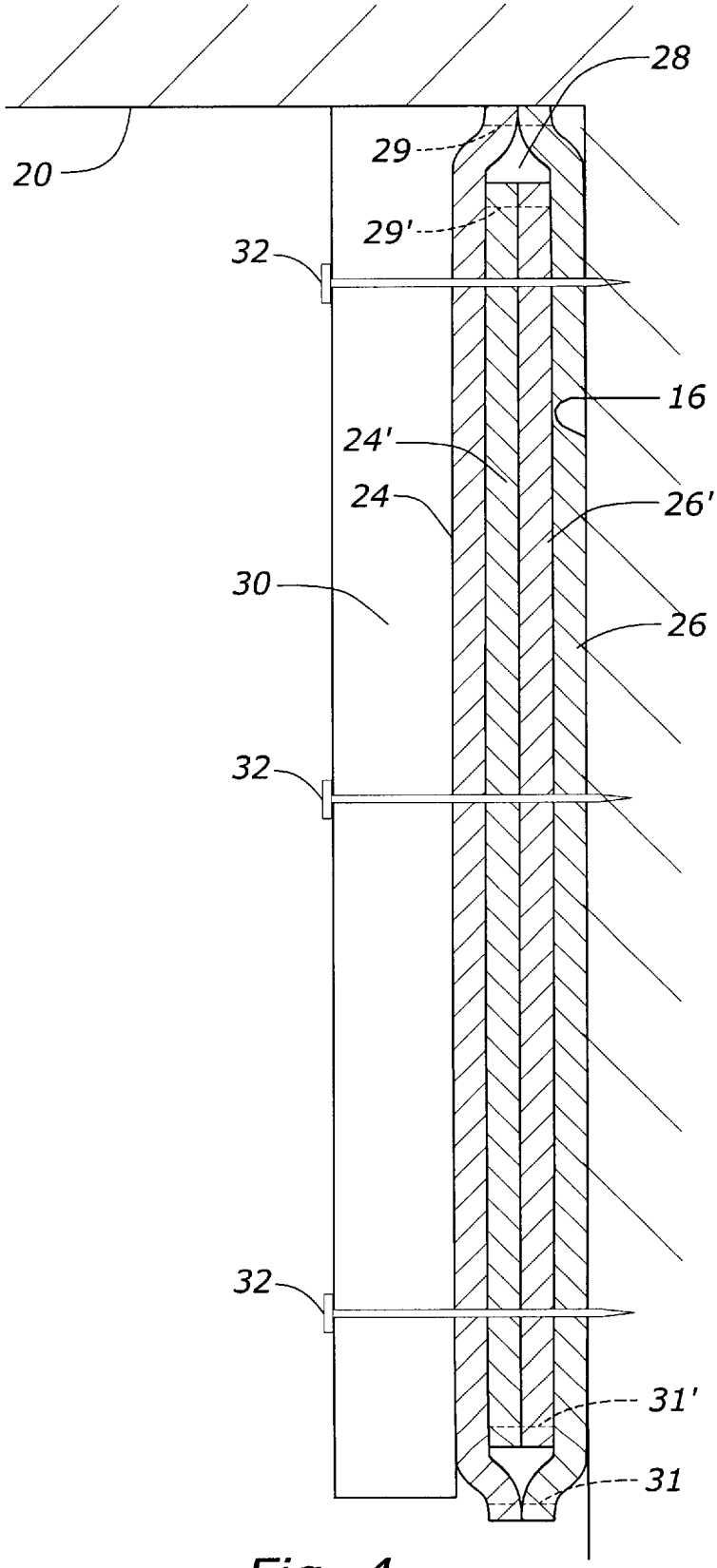
FIG. 4 is a sectional view taken along line 4—4 of FIG. 2.

A pair of corner reinforcing members 30 are shown positioned adjacent the two corners 18 (FIG. 1). The corner reinforcing members 30 are shown in more detail in FIG. 2. The reinforcing members 30 press the strip 10 into the corners 18 and a plurality of tacks 32 pierce each of the reinforcing members 30 as well as the strip 10 and extend into the wall 16 to secure the reinforcing member and the strip 10 in place. FIG. 4 shows the tacks 32 extending into the wall 16. While tacks are shown, screws, or other devices may be used to attach the corner members 30 and the strip 10 into the corners 18.

Figure 3:
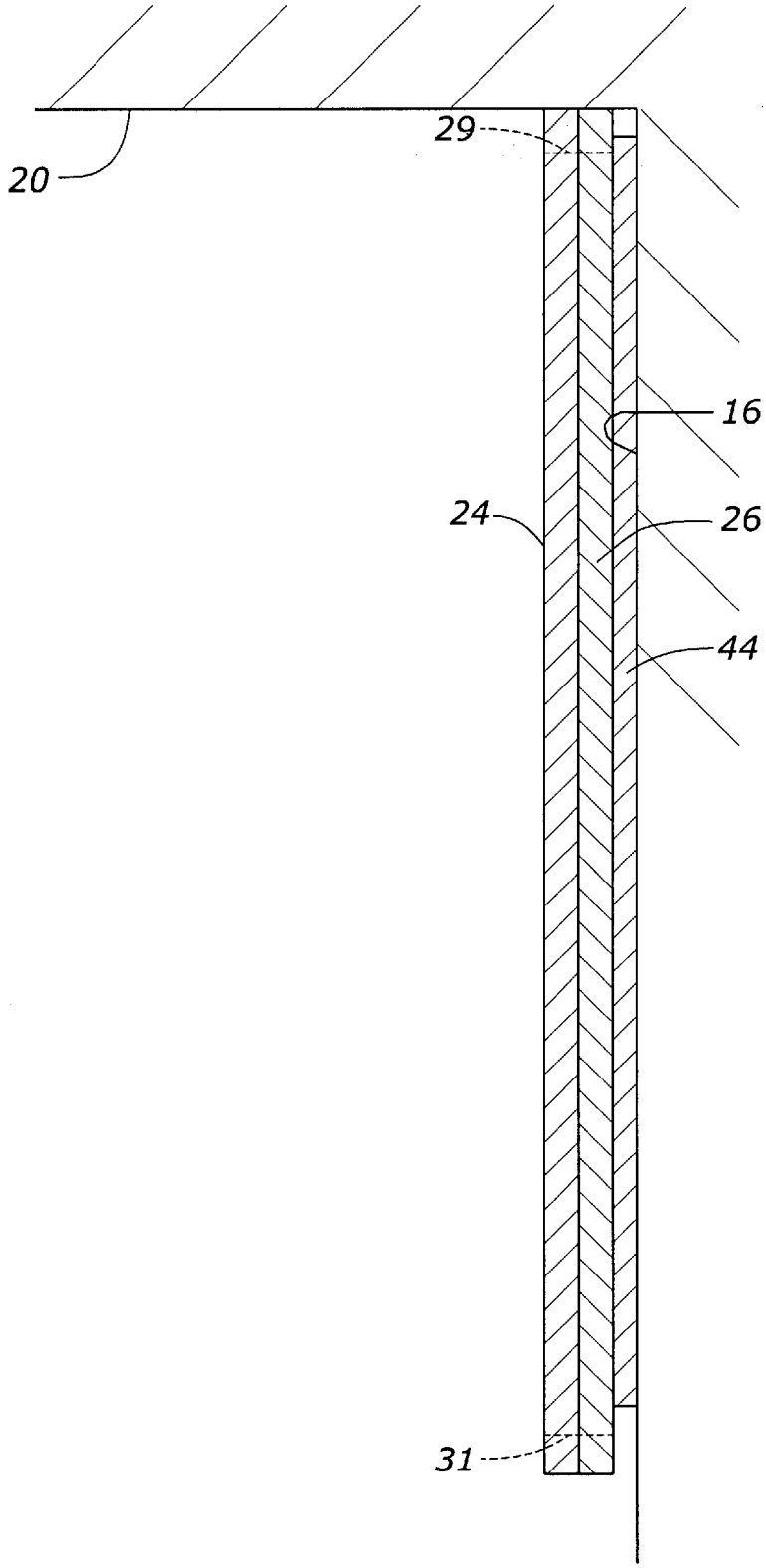
FIG. 3 is a sectional view taken along line 3—3 of FIG. 2.

At various places along the length of the strip 10 a double-sided tape 44 (FIGS. 2 and 3) may be used to help hold the strip 10 in place. This double-sided tape 44 adheres on one side to the rear panel 26 and on the other side to the wall 16.

In installation, it is preferable that the strip 10 be starched and flattened, perhaps by ironing, so that it provides a smooth flat surface. Then one of the corner members 30 is secured in place to secure the strip 10 to one of the corners 18. Next the strip is stretched to the next adjacent corner 18 and an additional corner member 30 is tacked in place. The reinforcing slats 42 help maintain the shape of the strip 10.

The strip 10 may be extended completely around the room. As can be seen in FIG. 4, one end of the strip designated by the numerals 24', 26' maybe tucked inside the envelope 28 of the other panels 24, 26 at the opposite end of strip 10. Tacks 32 go through the corner piece and through the two tucked in ends of the strip 10 as shown in FIG. 4. While three tacks are shown in FIG. 4, the number may vary without detracting from the invention. The preferred number of tacks it two.

The fabrics for panels 24, 26 may be chosen to match other fabric patterns within the room. Furthermore, the strip 10 can be removed quickly and easily and reversed to expose the rear panel 26 instead of the front panel 24.

There are several advantages to the present invention. The border can be reversed which provides two alternative patterns that may be used. In this regard the strip 10 does not necessarily need to be a double panel strip. It could be made from a single panel 24 without detracting from the invention.

The border is washable and vacuums easily. There is no glue or other messy material that would be used with this invention. It can be placed directly over the top of an old wallpaper border without having to remove the border. It can be installed very quickly, particularly if two people are working to install the strip. The corner pieces 30 may be made of wood, composite material, plastic, or other materials. They can be painted or matched to the particular décor desired. They can also be covered with fabric or painted.

Furthermore, the border can be stored or packaged conveniently. All that is necessary is to roll the border up into a roll and secure the roll with a rubber band to store the border.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

What is claimed is:

1. A decorative border for attachment to a plurality of walls having a plurality of comers there between, the border comprising:

an elongated strip of flexible decorative material having an elongated upper edge, and elongated lower edge, first and second opposite ends, a front face and a rear face;

an external reinforcing member engaging the front face of the strip;

an elongated fastening member extending through both the external reinforcing member and the front and rear faces of the strip and having an inner end adapted to penetrate one of the walls adjacent one of the corners between the walls;

a plurality of pockets spaced apart along the length of the strip, each of the pockets having a closed end adjacent the lower edge of the strip, opposite closed sides extending upwardly therefrom, and an open upper end;

an elongated rigid reinforcing member being within each of the pockets and having a substantially vertically oriented longitudinal axis.

2. A decorative border according to claim 1 wherein the elongated strip is of double thickness comprising first and second layers in face to face relation.

3. A decorative border according to claim 1 and further comprising a tape having tacky adhesive on first and second opposite sides thereof, the tape having the first side adhering to the back surface of the strip, the second side facing in the opposite direction for contacting one of the plurality of walls.

4. In combination:

a plurality of upstanding walls having a plurality of corners there between;

an elongated strip of flexible decorative material having an elongated upper edge, and elongated lower edge, first and second opposite ends, a front face and a rear face;

the strip extending in facing relation along at least three of the walls;

a first external reinforcing member engaging the front face of the strip and being positioned in a first corner between two of the walls;

a second external reinforcing member being positioned at a second comer between two of the walls;

an elongated first fastening member extending through both the first external reinforcing member and the front and rear faces of the strip and having an inner end penetrating one of the walls at the first comer between the two walls;

an elongated second external fastening member extending through both the second external reinforcing member and the front and rear faces of the strip and having an inner end penetrating one of the walls at the second corner to secure the second fastening member and the strip to the second corner.

5. A decorative border according to claim 4 wherein the elongated strip is of double thickness comprising first and second layers in face to face relation.

6. A decorative border according to claim 5 and further comprising a plurality of pockets spaced apart along the length of the strip; each of the pockets having a closed end adjacent the lower edge of the strip, opposite closed sides extending upwardly therefrom, and an open upper end; an elongated rigid reinforcing member being within each of the pockets and having a substantially vertically oriented longitudinal axis.

7. A decorative border according to claim 6 and further comprising a tape having tacky adhesive on first and second opposite sides thereof, the tape having the first side adhering to the back surface of the strip, the second side facing in the opposite direction for contacting one of the plurality of walls.

8. A decorative border according to claim 7 wherein the plurality of walls each have a top edge, the top edges of the plurality of walls being horizontally aligned, the upper edge of the strip being in horizontal registered alignment with the top edges of the walls.

9. A decorative border according to claim 7 wherein the plurality of walls each have a top edge, the top edges of the plurality of walls being horizontally aligned, the upper edge of the strip being horizontal and spaced below the top edges of the walls.

10. A method for decorating a plurality of walls of a room, the walls having a plurality of corners there between, the method comprising:

taking an elongated strip of decorative material having a longitudinal axis, an elongated upper edge, an elongated lower edge, first and second opposite ends, a front face and a rear face;

placing the rear face of the elongated strip in facing engagement with at least one of the walls so that it spans between at least first and second corners at opposite ends of the one wall with the longitudinal axis extending generally horizontally;

positioning a first and a second elongated reinforcing member in the first and second corners, respectively, with the elongated strip being between the first corner and the first reinforcing member and also being between the second wall and the second reinforcing member;

securing the first and second reinforcing members to the first and second corners, respectively, by elongated securing members extending through the first and second reinforcing members, through the strip, and into the wall adjacent the first and second corners, respectively.

11. A method according to claim 10 and further comprising placing an elongated internal reinforcing member in a pocket within the strip, the pocket being located between the first and second corners, and the elongated internal reinforcing member having a longitudinal axis extending generally in an upstanding position when the elongated external reinforcing member is in the pocket.

12. A method according to claim 10 and further comprising attaching two elongated flat layers together in fact to face relation to create a double thickness for the strip.

13. A method according to claim 12 and further comprising attaching the two flat layers together adjacent the upper and lower edges of the strip, and leaving the two flat layers open at the ends of the strip.

14. A method according to claim 13 wherein the walls combine to create an enclosed room, the method further comprising extending the strip around all the walls in the enclosed room and connecting one of the opposite ends of the strip to the other of the opposite ends of the strip by inserting the one end of the strip within and between the two flat layers of the other end of the strip.

15. A decorative border for attachment to a plurality of walls having a plurality of comers there between, the border comprising:

an elongated strip of flexible decorative material having a longitudinal strip axis, an elongated upper edge and an elongated lower edge both extending in the same direction as the longitudinal strip axis, first and second opposite ends, a front face and a rear face;

an elongated external reinforcing member engaging a covered portion the front face of the strip and leaving an uncovered portion of the front face of the strip exposed, the uncovered portion being substantially larger than the covered portion;

the reinforcing member having first and second member ends, an overall length extending between the first and second member ends and to the elongated upper and lower edges of the strip, and a longitudinal reinforcing member axis extending between the first and second ends of the reinforcing member and being perpendicular to the longitudinal strip axis;

at least one elongated fastening member extending through both the external reinforcing member and the front and rear faces of the strip and having an inner end adapted to penetrate one of the walls for attaching the reinforcing member and the strip to one of the walls.

* * * * *